United States Patent [19]

DeBoer

[11] 4,125,218

[45] Nov. 14, 1978

[54] MEGAPHONE-CUP

[76] Inventor: Paul A. DeBoer, 34 Crestwood Rd., Marblehead, Mass. 01945

[21] Appl. No.: 854,137

[22] Filed: Nov. 23, 1977

[51] Int. Cl.[2] ..... B65D 1/00

[52] U.S. Cl. ..... 229/1.5 B; 206/620

[58] Field of Search ..... 215/1 C; 229/1.5 B; 206/620, 634, 217; 181/141, 177, 192, 195

[56] References Cited

U.S. PATENT DOCUMENTS

| | | | |
|---|---|---|---|
| 1,079,903 | 11/1913 | Norton | 206/518 X |
| 1,332,789 | 3/1920 | Asano | 181/141 |
| 1,581,972 | 4/1926 | Mason | 181/141 |
| 2,507,843 | 5/1950 | Wheeler | 229/1.5 B |
| 2,982,440 | 5/1961 | Harrison | 229/1.5 B X |
| 3,468,467 | 9/1969 | Amberg | 229/1.5 B |
| 3,981,412 | 9/1976 | Asmus | 220/258 X |

*Primary Examiner*—Donald F. Norton
*Attorney, Agent, or Firm*—Charles E. Pfund

[57] ABSTRACT

A hollow, frustoconical structure having a conical side wall concentric with its longitudinal axis, an end wall at the end of smaller diameter frangibly connected to the side wall at the smaller end, said end wall being sufficiently firmly attached to the side wall as to enable employing the structure as a container for beverages, snack foods and the like and, yet, easily removable to enable employing the structure as a megaphone.

4 Claims, 7 Drawing Figures

MEGAPHONE-CUP

BACKGROUND OF INVENTION

Frustoconical containers comprised of stiff paperboard or the like have been made for many purposes heretofore; however, such structures as are known are manufactured for holding liquid or for filtering or funneling purposes. The structure herein disclosed is for the multiple purpose of serving, on the one hand, as a container for holding liquids or solids such as beverages, ice cream, popcorn, potato chips and the like and, on the other hand, following emptying, for use as a megaphone. This multiple use is especially attractive to concessionaries for the sale of beverages, ice cream, popcorn, potato chips and the like.

SUMMARY OF INVENTION

A hollow, elongate structure of right circular section with respect to its longitudinal axis, said structure being defined by a relatively thin side wall concentric with the longitudinal axis and a relatively thin end wall at the smaller end detachably connected to the side wall at the smaller end, said end wall comprising a bottom for the structure and being sufficiently firmly connected thereto so that the structure may be employed as a receptacle for beverages, snack foods and the like, but which may be fractured at the connection to remove it from said end, and said smaller end being so dimensioned that when the end wall is removed, said small end constituting a mouthpiece which corresponds substantially in diameter to the mouthpiece of a conventional megaphone so that the structure can be used as a megaphone. The side wall and bottom wall are formed integrally and the junction connecting the same is of reduced thickness such as to be frangible. Preferably, the bottom wall is spaced axially from the smaller diameter end toward the larger diameter end by an amount at least equal to the thickness of the bottom so that the structure will set stably on its lower end and, desirably, there is a reinforcing bead peripherally of the larger diameter end.

The invention will now be described in greater detail with reference to the accompanying drawings, wherein.

Figure 1:
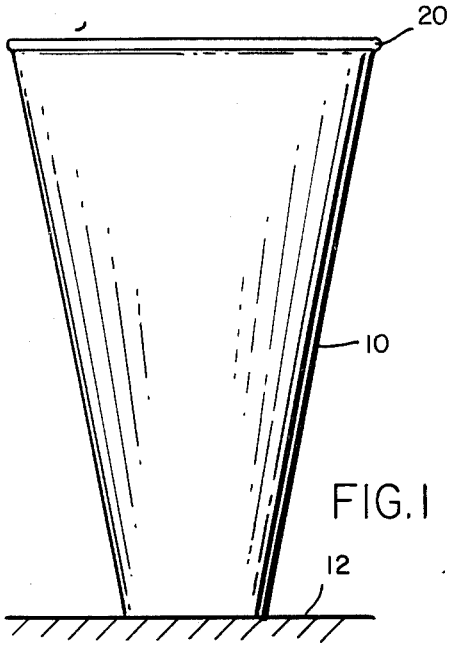
FIG. 1 is an elevation of the structure shown resting on its lower, smaller-diameter end on a support for use as a container.
Figure 2:
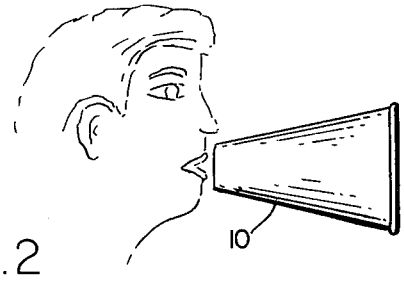
FIG. 2 is an elevation of the structure to much smaller scale showing its use as a megaphone.
Figure 4:
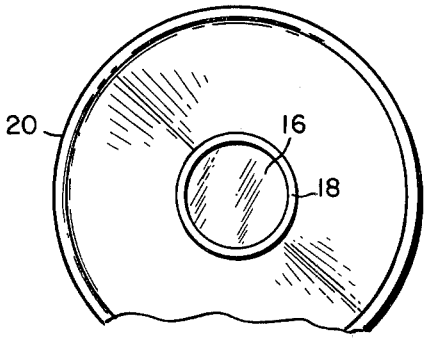
FIG. 4 is a plan view looking down into the open end of the structure.

Referring to the drawings, the multiple purpose structure shown herein is used, on the one hand, as shown in FIG. 1, as a container for beverages and snack foods and, when used for such a purpose, can be placed upright on its lower, smaller-diameter end on a supporting surface 12. Following use as a container, as will appear hereinafter, the structure can be used as a megaphone, the smaller end being so dimensioned that it corresponds substantially in diameter to the mouthpiece of a conventional megaphone, as illustrated in FIG. 2.

Figure 3:
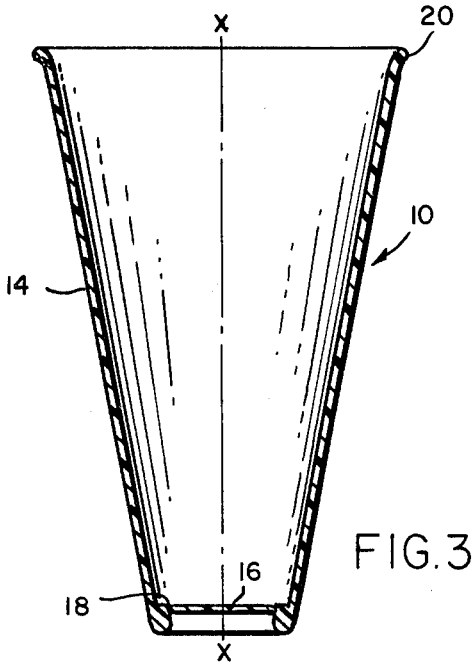
FIG. 3 is a vertical diametral section of the structure shown in FIG. 1.
Figure 7:
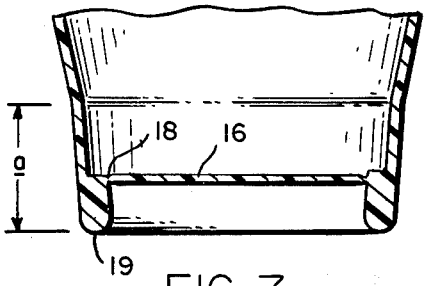
FIG. 7 is a fragmentary section at the lower end of the structure showing the lower portion formed with a lesser taper than the portion above it.
Figure 5:
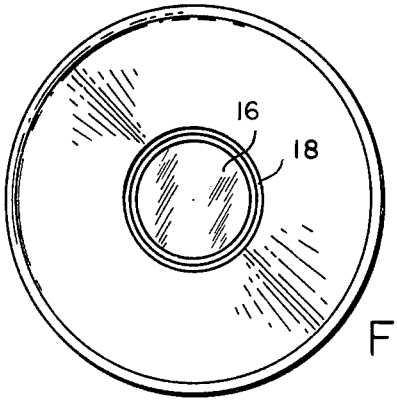
FIG. 5 is a bottom view looking up at the bottom of the structure.
Figure 6:
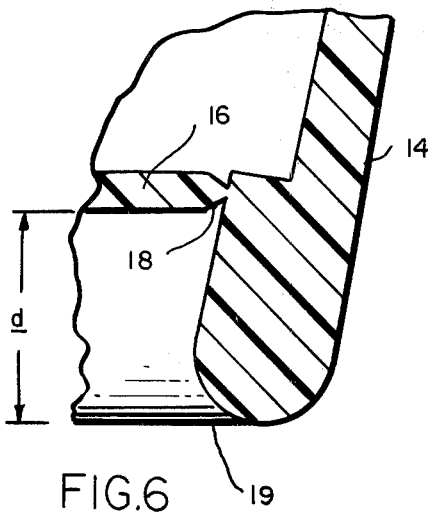
FIG. 6 is a fragmentary section to much larger scale showing the junction of the bottom with the side walls.

The structure 10, FIGS. 1 and 3, is of frustoconical configuration, having a smooth side wall 14 which is concentric with its longitudinal axis X—X and a smooth end wall 16 at its lower, smaller-diameter end which is connected to the side wall by a frangible connection 18, FIG. 6, of lesser thickness than the thickness of the side and end walls.

The end and side walls are formed integral, for example, of resin-impregnated paperboard or thermoplastic, such as polyolefin, and the junction 18 is of lesser thickness and, hence, frangible so that the end wall can be removed is, nevertheless, sufficiently strong to enable filling the structure with a beverage, ice cream, popcorn or peanuts, without rupture and, yet, sufficiently fragile so that when the container is emptied of its contents, the bottom 16 can be removed and the structure then used as a megaphone by placing the smaller end to the mouth of the person using it.

As shown in FIG. 6, the bottom wall 16 is spaced inwardly from the lower end by an amount d at least equal to the thickness of the bottom part of the bottom wall so that when the structure is placed on the supporting surface, only the lower edge 19 of the side wall has contact with the supporting surface 12, thus ensuring stability, and the portion of the side wall below the bottom wall is made approximately twice as thick as the side wall above the bottom and rolled at its lower edge 19 so as to provide a smooth, firm mouthpiece which will not chap or burn the lips. Desirably, a portion of the side wall at the lower end as indicated at *a* may be formed with a lesser taper, that is, more nearly cylindrical to better hold it to the mouth when using it as a megaphone. For reinforcement purposes, the larger diameter upper end has peripherally thereof a bead 20.

The side wall thickness is approximately 0.002 inches, the bottom wall thickness is approximately 0.040 inches, and the junction connecting the bottom wall 16 to the side wall tapers from a thickness of approximately 0.040 inches which is the thickness of the bottom wall to approximately 0.010 inches where it joins the side wall. The overall dimensions, but without limitation, are an axial length of approximately 7⅛ inches, a diameter at the to of approximately 5⅛ inches, and a diameter at the bottom of approximately 1⅛ inches.

The structure, as previously indicated, can be made of resin-impregnated paperboard or of any suitable thermoplastic resin which may be blow-molded or injection-molded. Polyolefin has been already mentioned; however, linear polyethylene, polypropylene and any equivalent of the foregoing may be used.

The double use of the device as described and suitably decorated, for example, with the colors or names of the participating teams, makes it especially popular to concessionaires at sporting events in that it encourages the sale of beverages, ice cream, snack food and the like and; to some extent, discourages immediate discard when it has been emptied because of its secondary use as a megaphone and as a souvenir which can be taken home, thereby greatly reducing the problems of trash removal.

It should be understood that the present disclosure is for the purpose of illustration only and includes all modifications or improvements which fall within the scope of the appended claims.

I claim:

1. A hollow frustoconical structure of circular right section with respect to its longitudinal axis, said structure having ends which are defined by rounded edges concentric with said longitudinal axis and which lie in planes perpendicular to said axis, such as to enable standing the structure upright on the smaller end in stable equilibrium and a closure member at the smaller end situated inwardly from the rounded edge forming a bottom for the structure to enable using the structure as a receptacle when set down upon its smaller end, means detachably connecting the bottom to the wall of the structure inwardly of said rounded edge to enable removing the bottom so that the structure may be used for a megaphone and said smaller end of the structure being consistent in diameter with the diameter of the mouthpiece of a conventional megaphone.

2. A structure according to claim 1 wherein a portion of the side wall at the smaller end is provided with a lesser taper than that above it to be more nearly consistent with a mouthpiece.

3. A hollow, elongate, one-piece structure molded of polyolefin, said structure having a tapering side wall symmetrically with respect to its longitudinal axis and being truncated at its smaller end in a plane perpendicular to said axis such that the edge of the side wall at the smaller end serves as a base for supporting the structure in an upright position of stable equilibrium, said edge being smoothly rounded, an end wall at the smaller end situated inwardly of the plane of said smoothly rounded edge integrally connected to the side wall of the structure, said end wall forming a bottom for the structure when set upright on its truncated end to enable using the structure as a receptacle, a portion of reduced thickness connecting the end wall to the side wall of the structure of sufficient strength to withstand pressure on the bottom when the structure is filled with liquid, but frangible enough to enable detaching it from the side wall inwardly of the rounded edge by applying a force perpendicular to the bottom to open the smaller end without modifying the rounded end structure of the side wall at the smaller end as a mouthpiece for using the structure as a megaphone and wherein the smaller end is of a diameter consistent with the mouthpiece of a conventional magaphone.

4. A structure according to claim 3 wherein a portion of the side wall at the smaller end is provided with a lesser taper than that above it to be more nearly consistent with a mouthpiece.

* * * * *

UNITED STATES PATENT AND TRADEMARK OFFICE

CERTIFICATE OF CORRECTION

PATENT NO. : 4,125,218

DATED : November 14, 1978

INVENTOR(S) : Paul A. DeBoer

It is certified that error appears in the above-identified patent and that said Letters Patent are hereby corrected as shown below:

Column 2, line 47, "1 1/8" should read -- 1 5/8 --.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*